US006299489B1

(12) United States Patent
Phillips et al.

(10) Patent No.: US 6,299,489 B1
(45) Date of Patent: Oct. 9, 2001

(54) SLEEVE TERMINAL

(75) Inventors: Kevin Paul Phillips, Chagrin Falls, OH (US); David A Simoni, Sterling Heights, MI (US); William L. Stein, Sr., Warren, OH (US); John M Sova, Cortland, OH (US); William G Strang, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/543,475

(22) Filed: Apr. 6, 2000

(51) Int. Cl.[7] ..... H01R 24/00; H01R 33/20

(52) U.S. Cl. ..... 439/675; 439/252

(58) Field of Search ..... 439/578, 595, 439/843, 607, 675, 839, 252

(56) References Cited

U.S. PATENT DOCUMENTS

| | | | | |
|---|---|---|---|---|
| 3,187,297 | * | 6/1965 | Gluntz | 439/871 |
| 3,445,930 | * | 5/1969 | Shlesinger, Jr. | 29/874 |
| 4,938,720 | * | 7/1990 | Romak | 439/839 |
| 5,775,960 | | 7/1998 | Saito et al. | 439/843 |
| 5,776,601 | | 7/1998 | Fournier et al. | 428/701 |
| 5,787,866 | | 8/1998 | Sugiyama et al. | 123/672 |

OTHER PUBLICATIONS

Molex–Etc™ Special Devices—Snap Plugs, Snap Plug Receptacles, Wire Pin Terminals, Molex, Inc. 2222 Wellington Court, Lisle, IL 60532; Date Unknown.

* cited by examiner

*Primary Examiner*—Brian Sircus
*Assistant Examiner*—Brian S. Webb
(74) *Attorney, Agent, or Firm*—Richard A. Jones

(57) ABSTRACT

A sleeve terminal which provides a continually assured level of normal force with respect to a received pin terminal, even as the sleeve member thereof may tend to relax over time. The sleeve terminal includes a sleeve member having a slot which allows the sleeve member to be resiliently expanded when a pin terminal is inserted therewithin. A pair of resilient arms characterized by an opposing V-shape are formed integrally with the sleeve member on opposing sides of the slot. The apex of the resilient arms provides a contact location with the inner surface of a barrel which is concentrically receives the sleeve terminal. A free end of each resilient arm is spaced a predetrmined distance from the sleeve member. A wire mount is connected to the sleeve member opposite the slot. In operation, a pin terminal is inserted into the sleeve member, causing the sleeve member to be resiliently expanded as the slot widens. The sleeve terminal is then received into a barrel, during which operation the resilient arms tend to become flattened, eventually resulting in the free ends abutting the sleeve member, whereupon any further compression of the resilient arms is accompanied by an increased application of normal force against the inner surface of the barrel in one direction and against the sleeve member, and in turn the pin terminal, in the opposite direction.

9 Claims, 6 Drawing Sheets

SLEEVE TERMINAL

TECHNICAL FIELD

The present invention relates to sleeve terminals structured for resiliently contacting a pin terminal concentrically received therein and for providing a ground plane to an internal wall of a barrel shaped shield.

BACKGROUND OF THE INVENTION

Sleeve terminals provide an electrical connection with a pin terminal which is concentrically received by a slotted sleeve member of the sleeve terminal, where in the sleeve member is resiliently expanded by the pin terminal and presses thereagainst. A typical example of a sleeve and pin terminals connection is that of a spark plug wire sleeve terminal which receives therein the pin terminal at the top of a spark plug.

An interesting example of a sleeve terminal is presented in U.S. Pat. No. 5,775,960, and is generally reproduced at FIGS. 1 and 2. As shown at FIG. 1, a sleeve terminal 10 is composed of a pair of opposed resilient arms 12, 14 which are connected to a base 16, which is, in turn, connected to a wire mount 18. The resilient arms 12, 14 are separated from each other by slits 20, 22, and each feature a forward flaired end 24, 26 (which collectively form what is basically a sleeve member of the sleeve terminal). The resilient arms 12 14 are inserted into a barrel 28 having an access opening 30. As shown at FIG. 2, a pin terminal 32 is then inserted through the access opening 30 and between the resilient arms 12, 14, causing them to deflect away from each other as they resiliently press against the pin terminal.

While a sleeve terminal does offer a good electrical connection with a received pin terminal, there is a danger that the sleeve member may relax and no longer provide a secure normal force against the pin terminal. If the sleeve member should loose good abutting contact with the pin terminal, the electrical connection therebetween is then compromised. Unfortunately, over time due to vibration and heat, among other things, the sleeve member can relax, whereby the normal force of the sleeve member against the pin terminal reduces commensurately. Accordingly, it is seen that when the normal force of the sleeve member decreases, there is introduced potential loss of electrical continuity between the sleeve terminal and the received pin terminal.

Accordingly, what remains needed in the art is a sleeve terminal which provides an assured level of normal force with respect to a received pin terminal, besides providing a ground plane to an internal wall of a barrel shaped shield.

SUMMARY OF THE INVENTION

The present invention is a sleeve terminal which provides a continually assured level of normal force with respect to a received pin terminal and an internal surface of a barrel, even as the sleeve member thereof may tend to relax over time.

The sleeve terminal according to the present invention includes a sleeve member having a slot which allows the sleeve member to be resiliently expanded when a pin terminal is inserted therewithin. A pair of resilient arms characterized by an opposing V-shape are formed integrally with the sleeve member on opposing sides of the slot. The apex of each of the resilient arms is located radially remote from the sleeve member and provides a contact location with the inner surface of a barrel which is concentrically receives the sleeve terminal. A free end of each resilient arm is spaced a predetermined distance from the sleeve member. A wire mount is connected to the sleeve member opposite the slot.

In operation, a pin terminal is inserted into the sleeve member, causing the sleeve member to be resiliently expanded as the slot widens, whereupon the sleeve member applies a normal force on the pin terminal. The sleeve terminal is then received into a barrel, during which operation the apices forcefully abut the barrel at opposing locations of the inner surface thereof. This forceful abutment of the barrel with the apices results in the resilient arms being compressed toward the sleeve member such that the V-shape of the resilient arms tends to become flattened, eventually resulting in the free ends abutting the sleeve member. Once the free ends abut the sleeve member, any further compression of the resilient arms is accompanied by an increased application of normal force against the inner surface of the barrel in one direction and against the sleeve member, and in turn the pin terminal, in the opposite direction. As a result, even if the sleeve member may tend to relax over time due to vibration or heat, the incremented normal force due to the compressed resilient arms will continuously supply an adequate level of normal force to ensure electrical continuity between the sleeve member and the pin terminal, as well as the sleeve member and the barrel, over time.

Accordingly, it is an object of the present invention to provide a sleeve terminal which is not sensitive to sleeve member relaxation over time, and provides a ground plane to an internal wall of a barrel shaped shield.

This, and additional objects, advantages, features and benefits of the present invention will become apparent from the following specification.

DETAILED DESCRIPTION OF THE PREFERRED EMBODIMENT

Figure 1:
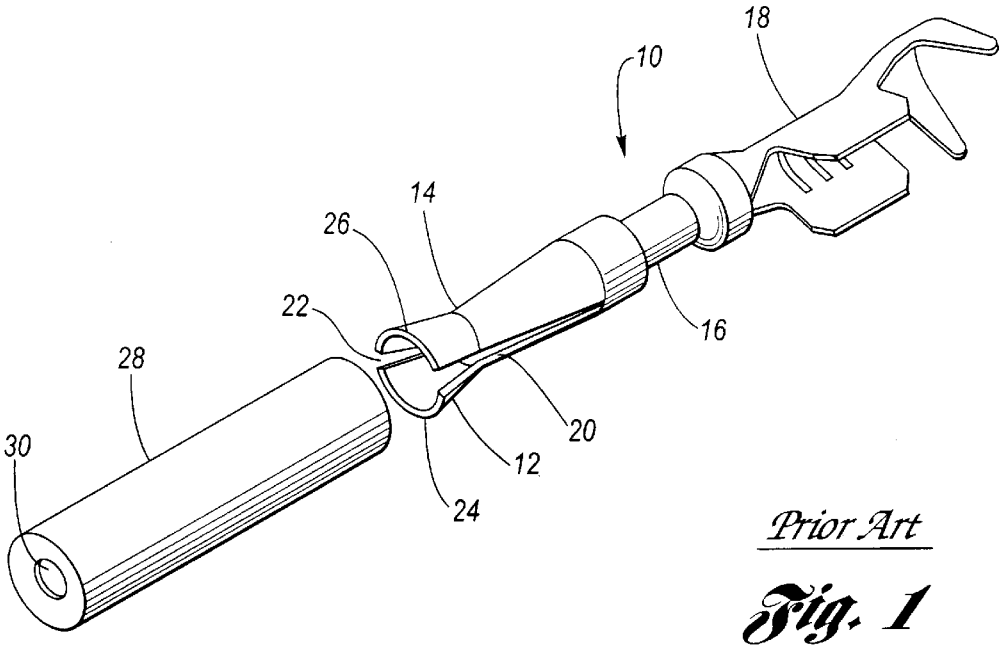
Prior Art Fig. 1
FIG. 1 is a perspective view of a prior art sleeve terminal.
Figure 2:
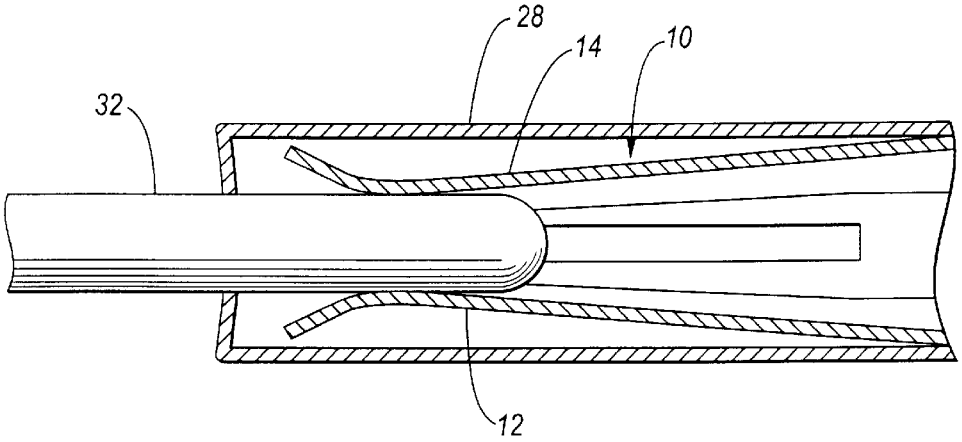
Prior Art Fig. 2
FIG. 2 is a partly sectional side view of the prior art sleeve terminal of FIG. 1, shown in operation with a pin terminal.
Figure 3:
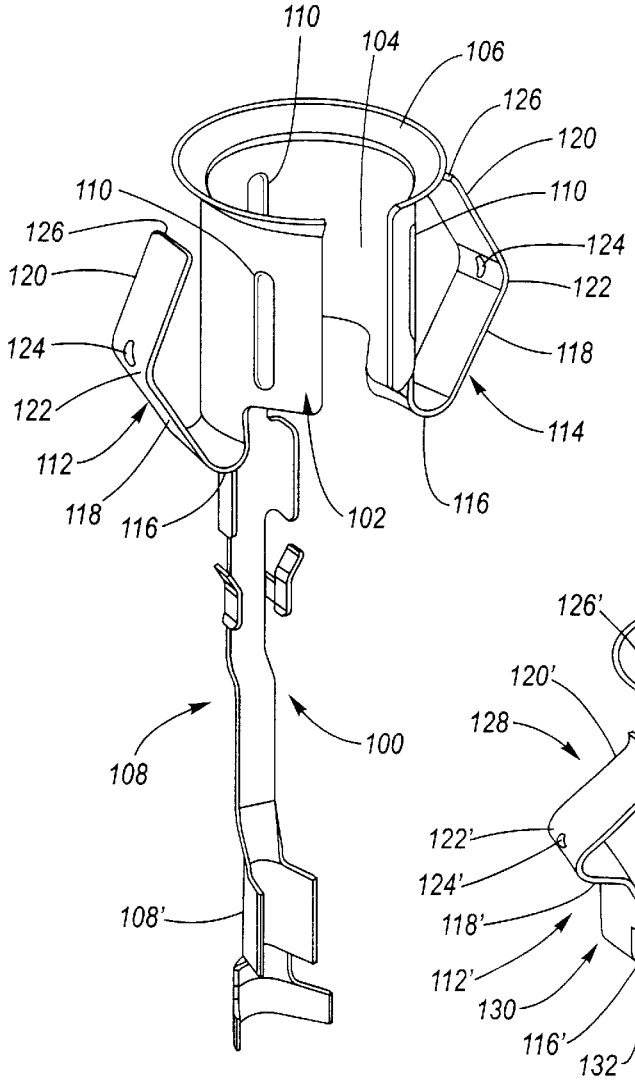
FIG. 3 is a perspective view of a sleeve terminal according to the present invention.
Figure 4:
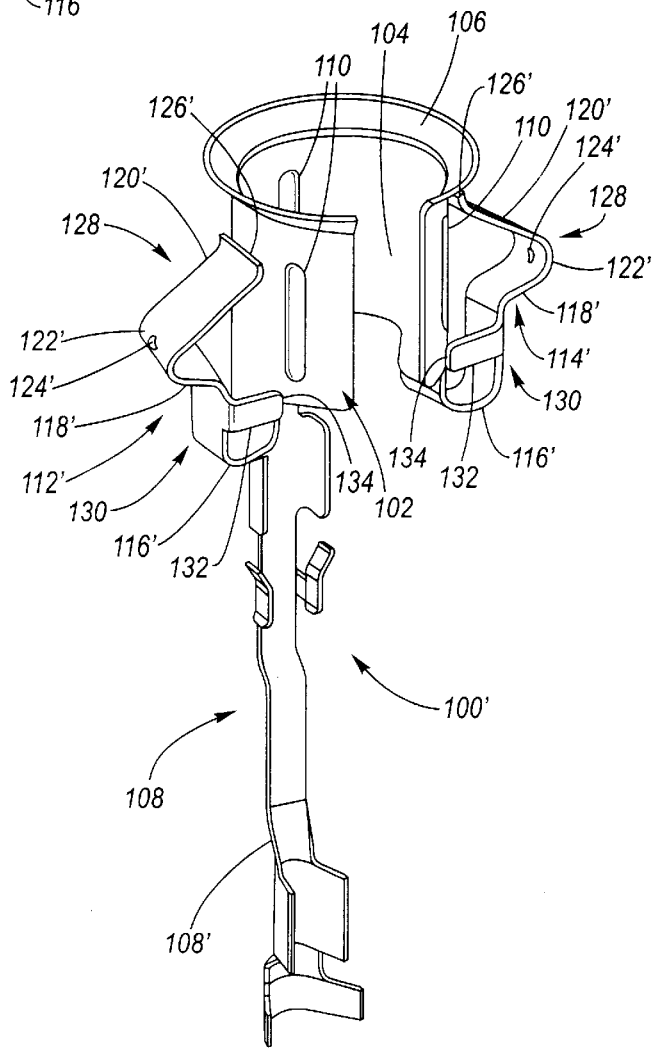
FIG. 4 is a is perspective view of a most preferred form of the sleeve terminal according to the present invention.

Referring now to the Drawing, FIGS. 3 through 11 depict a sleeve terminal according to the present invention, wherein FIGS. 3 and 4 depict alternative views of the sleeve terminal 100, 100', the sleeve terminal 100' being most preferred.

Common to each sleeve terminal 100, 100' is a sleeve member 102 having a slot 104 which allows the sleeve member to be resiliently expanded when a pin terminal is inserted therewithin. In this regard, a flaired mouth 106 at a lower end of the sleeve member 102 facilitates insertion of a pin terminal into the sleeve member. Each sleeve terminal 100, 100' further includes one of more electrical interface members 108, as for example wire mounts 108', as shown. The sleeve member preferably has a plurality (three being shown) of elongated dimples 110 which are depressed inwardly and provide contact surfaces for a pin terminal. Uncommon to each sleeve terminal 100, 100' is the shape of the resilient arms connected with the respective sleeve member.

With regard to sleeve terminal 100 shown at FIG. 3, a pair of resilient arms 112, 114 are integrally connected at a bent end 116 thereof with an upper end of the sleeve member 102 opposite the flaired mouth 106, at opposing sides of the slot 104. The resilient arms 112, 114 are identical, each having a general V-shape, each oriented in opposition to the other, and each composed of first arm sections 118, about equally long second arm sections 120 and an apex 122 formed therebetween. The apex 122 of each of the resilient arms 112, 114 provides a contact location with an inner surface of a barrel which concentrically receives the sleeve terminal. The contact location at the apices 122 is preferably in the form of a dimple 124 embossed away from the sleeve member 102. A free end 126 of each resilient arm is freely spaced from the sleeve member 102.

With regard to sleeve terminal 100' shown at FIG. 4, a pair of resilient arms 112', 114' are integrally connected at a bent end 116' thereof with the upper end of the sleeve member 102 opposite the flaired mouth 106, at opposing sides of the slot 104. The resilient arms 112', 114' are identical, each having a general V-shape portion 128, each oriented in opposition to the other, and each V-shape portion being composed of first arm sections 118', longer second arm sections 120' and an apex 122' formed therebetween. The apex 122' of each of the resilient arms 112', 114' provides a contact location with an inner surface of a barrel which is concentrically receives the sleeve terminal. The contact location at the apices 122' is preferably in the form of a dimple 124' embossed away from the sleeve member 102. At the bent end 116' each resilient arm 112', 114' has a straight portion 130 which is oriented generally parallel to the center axis of the sleeve member 102, and which connects to the V-shape portion 128. A tab 132 is integrally formed with the straight portion 130 and is oriented perpendicularly thereto toward the sleeve member 102 such that the tip 134 thereof is spaced therefrom. A free end 126' of each resilient arm is preferably up-bent and is freely spaced from the sleeve member 102.

Figure 5:
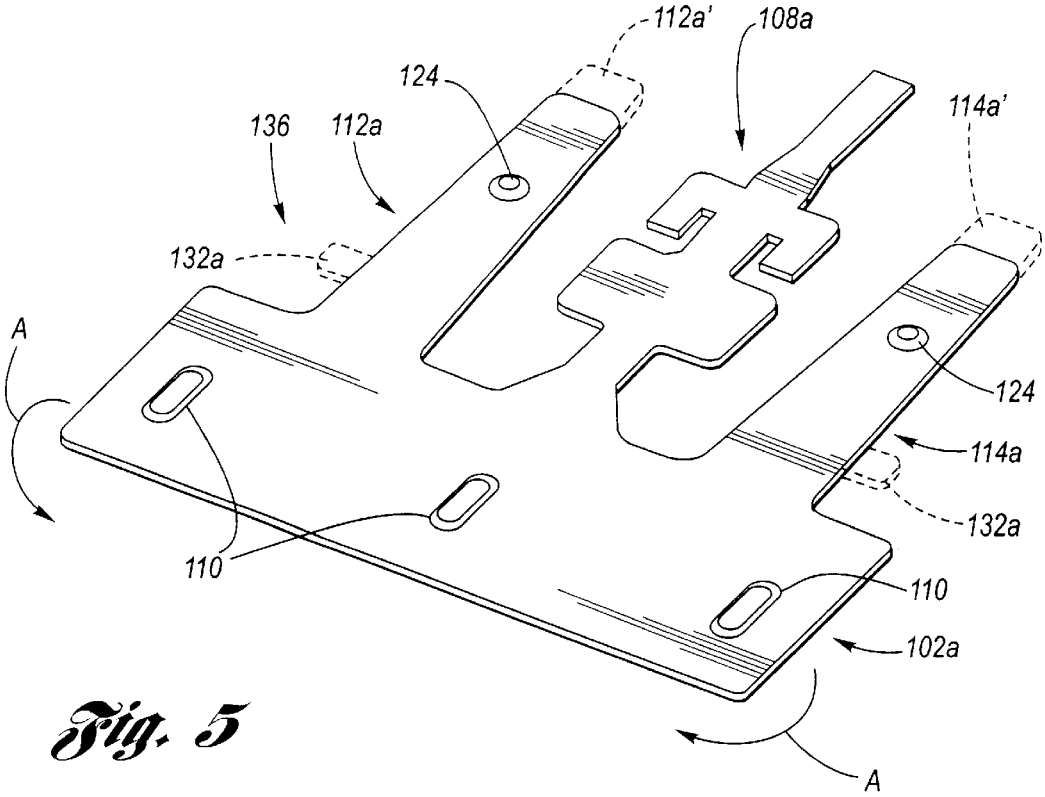
FIG. 5 is a perspective plan view of a metal blank for making the sleeve terminal according to the present invention.
Figure 6:
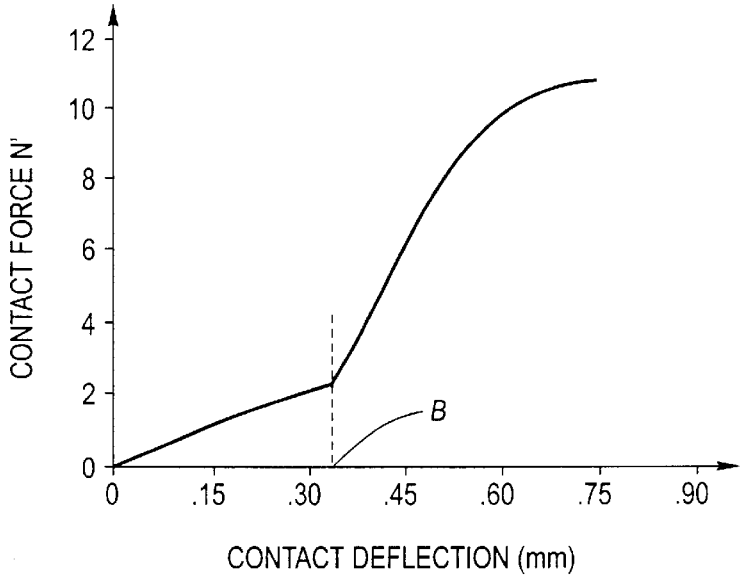
FIG. 6 is a graph of normal force as a function of deflection of the resilient arms of the sleeve terminal according to the present invention.
Figure 7:
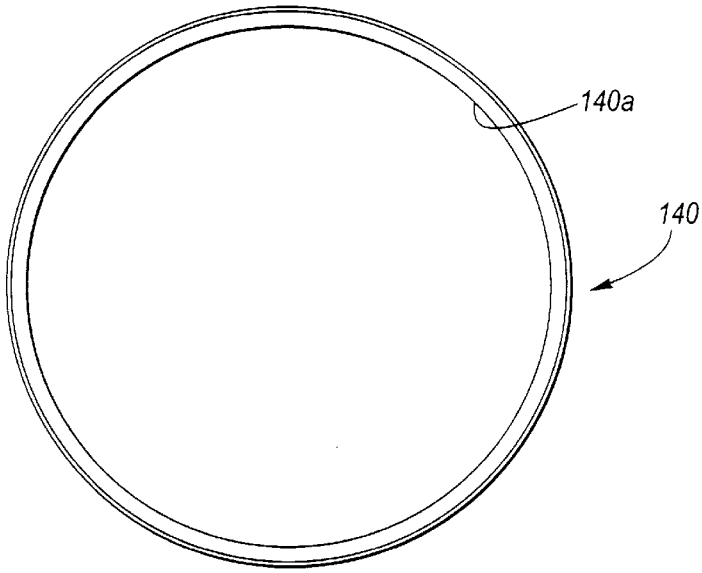
FIGS. 7 through 9 are progressive end views of a sleeve terminal according to the present invention operatively engaged with a barrel and a pin terminal.

FIG. 5 depicts a metal blank 136 for providing the sleeve terminal 100, wherein the dashed lines depict portions for forming the sleeve terminal 100'. The sleeve terminal 100, 100' is formed by stamp cutting the blank 136 from sheet metal stock, preferably a plated stock. The dimples 110, 124, are embossed. A center blank stem 108*a* is bent to provide the electrical interface 108. Left and right blank stems 112*a*, 114*a* are bent provide the resilient arms 112, 114 of the sleeve terminal 100; wherein the left and right blank stems including end portions 112*a'*, 114*a'* and blank tabs 132*a*, are bent to form the resilient arms 112', 114' of the sleeve terminal 100'. The blank 136 is rolled along arrows A to form the sleeve member 102 from a blank base 102*a*.

Operation of the sleeve terminal 100, 100' will now be described with reference being made to FIGS. 6 through 13.

Figure 8:
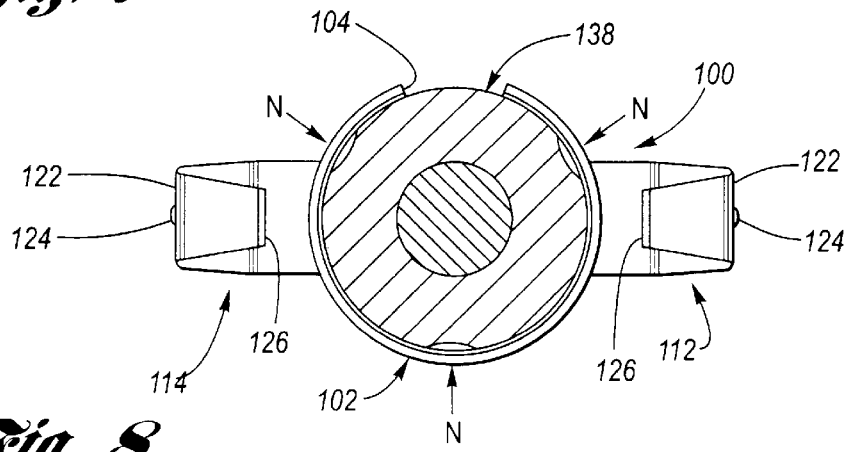
Figure 9:
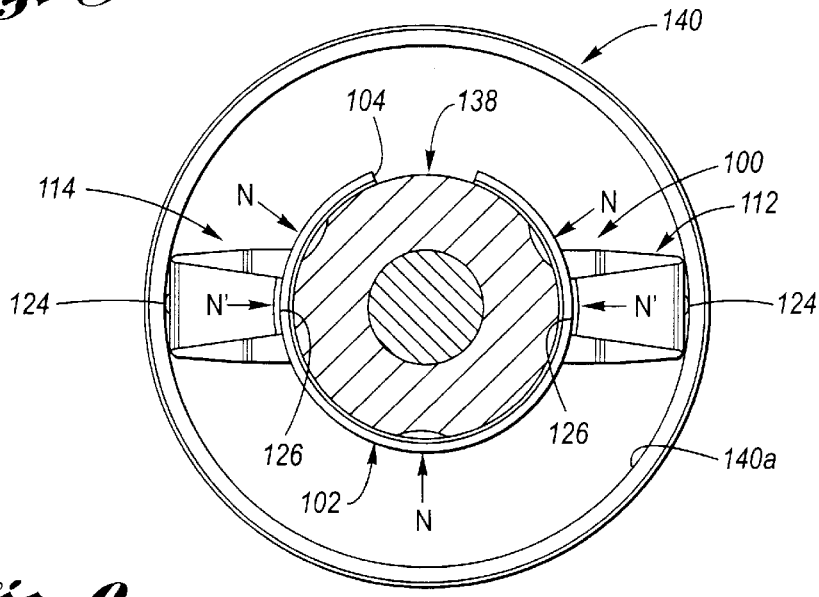
Figure 10:
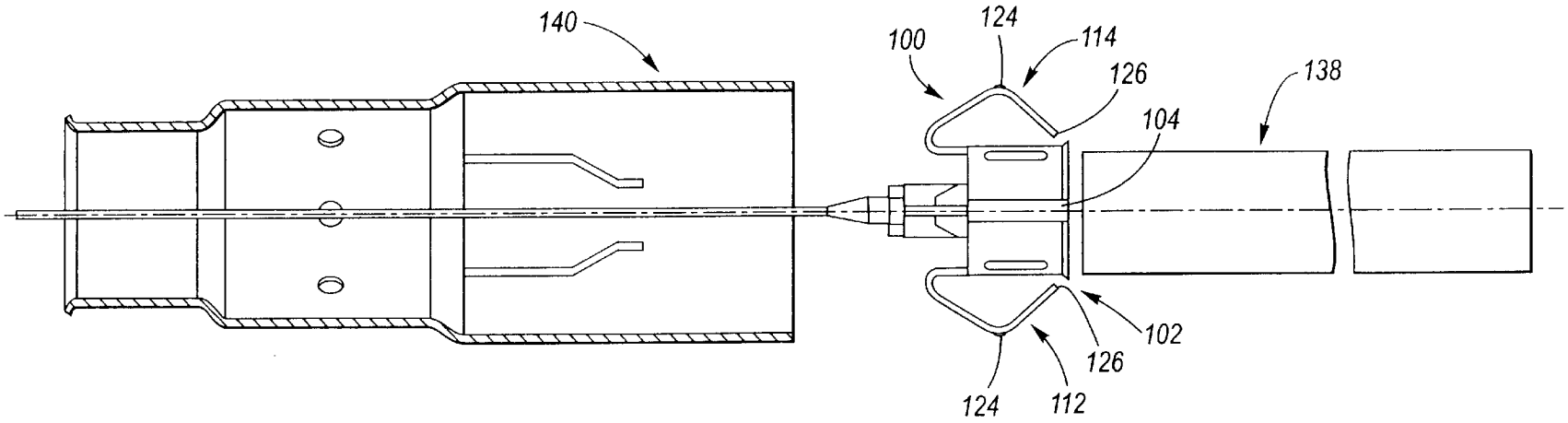
FIGS. 10 and 11 are progressive side views of a sleeve terminal according to the preset invention operatively engaged with a barrel and a pin terminal.
Figure 11:
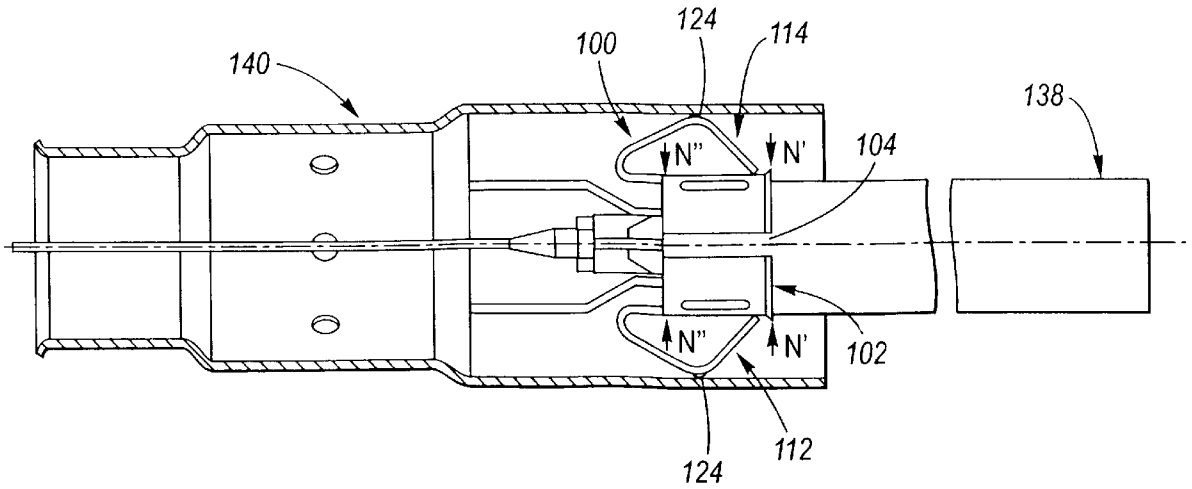

Turning attention firstly to FIGS. 7 through 11 the sleeve terminal 100 is used, by way of example, with respect to an oxygen sensor electrode 138 (which is, in this example, the equivalent of a pin terminal) and an oxygen sensor outer shield 140 (which is, in this example, the equivalent of a barrel). The electrode 138 is inserted into the sleeve member 102, as shown at FIG. 8. Thereduring, the sleeve member 102 is caused to resiliently expand and, as a consequence, applies a normal force N onto the electrode 138. The apices 122, and the dimples 124 thereof, are mutually separated a distance larger than the inside diameter of the outer shield 140. As a result, when the combination of the sleeve terminal 100 and electrode 138 are placed into the outer shield 140, the apices 122 (via the dimples 124) forcefully abut the outer shield at opposing locations of the inner surface 140*a* thereof. This forceful abutment of the apices 122 with the inner surface 140*a* results in the resilient arms 112, 114 being compressed toward the sleeve member 102 such that the V-shape of the resilient arms tends to become flattened, eventually resulting in the free ends 126 abutting the sleeve member, as shown at FIGS. 9 and 11. Once the free ends 126 abut the sleeve member 102, any further compression of the resilient arms is accompanied by an increased application of normal force N' against the inner surface 140*a* in one direction and against the sleeve member 102 toward the electrode 138. An example of the normal force N' is graphically depicted at FIG. 6, wherein the ends 126 abut the sleeve member 102 at point B. Accordingly, as shown at FIG. 11, normal forces N' and N" are applied to the sleeve member 102 in a direction toward the electrode 138. As a result, even if the sleeve member 102 may tend to relax over time due to vibration or heat, the incremented normal forces N', N" due to the compressed resilient arms will continuously supply an adequate level of normal force to ensure electrical continuity between the sleeve member and the electrode 138, the ground continuity between the sleeve member and the outer shield, as well.

Figure 12:
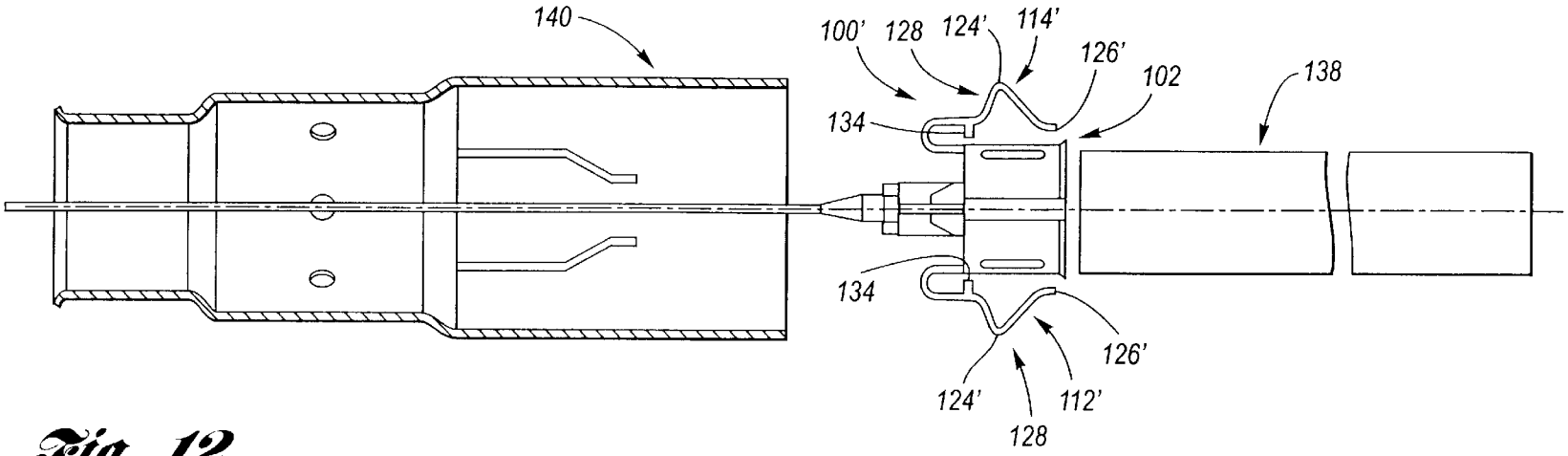
FIGS. 12 and 13 are progressive side views of a most preferred sleeve terminal according to the present invention operatively engaged with a barrel and a pin terminal.
Figure 13:
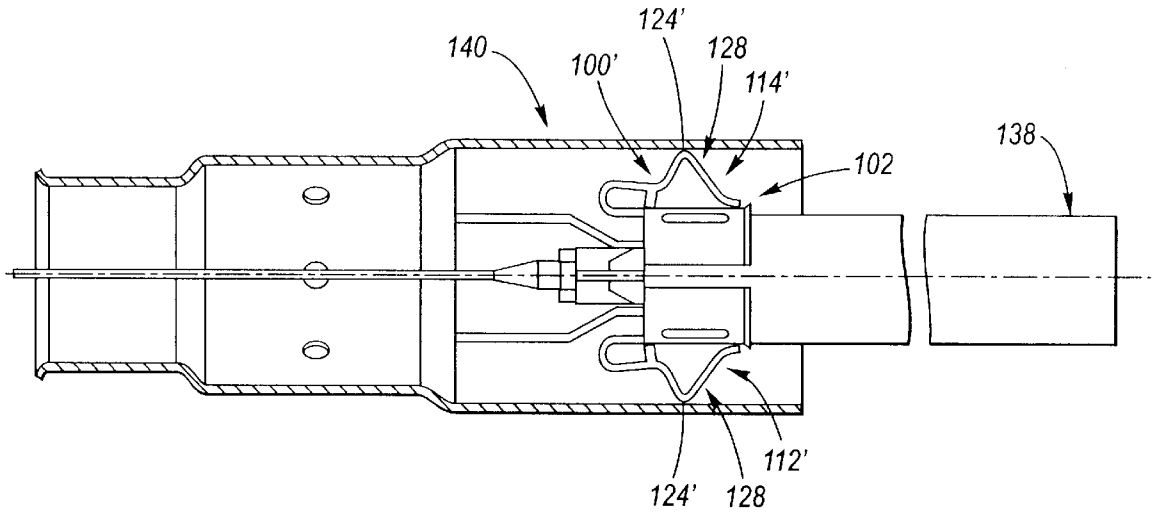

In that the normal force N" may be less than N' because of the resiliency at the bent end 116, it may be preferred to instead use the sleeve terminal 100' which makes the normal force more uniformly distributed onto the sleeve member 102, and provide a ground to the outer shield, besides concentrically centering the sleeve member with respect to the outer shield. As shown at FIGS. 12 and 13, the electrode 138 is placed into the sleeve member 102 as recounted hereinabove. Now, when the electrode and sleeve terminal 100' are received into the outer shield 140, when the V-shape portion 128 is flattened by the dimples 124' abutting the inside surface 140*a*, the free ends 126' and the tips 134 abut the sleeve terminal, thereby applying a more uniformly distributed normal force N'" onto the sleeve member 102, and thereby, against the electrode 138. Further, it will be noted that the resilient arms provide a ground to the outer shield and further serve to concentrically locate the sleeve member with respect to the barrel (which here, as in the example above, is the outer shield).

To those skilled in the art to which this invention appertains, the above described preferred embodiment may be subject to change or modification. Such change or modification, such as for example a modification of the shape of the resilient arms, can be carried out without departing from the scope of the invention, which is intended to be limited only by the scope of the appended claims.

What is claimed is:

1. A sleeve terminal comprising:

a resiliently expandable sleeve member, wherein said sleeve member has an upper end and an opposite lower end; and a plurality of resilient arms connected with said sleeve member, each resilient arm having at least a portion thereof characterized by a substantially V-shape, wherein the V-shape defines an apex located radially remote from the sleeve member, wherein each resilient arm comprises a bent end integrally connected with said upper end of said sleeve member, wherein each resilient arm further comprises a free end opposite the bent end thereof, and wherein the free end of each resilient arm is radially juxtaposed said sleeve member.

2. The sleeve terminal of claim 1, wherein said V-shape comprises substantially all of each resilient arm of said plurality of resilient arms.

3. The sleeve terminal of claim 2, wherein said sleeve member comprises a slotted sleeve; and wherein said plurality of resilient arms comprises a pair of mutually opposed resilient arms located on either side of a slot of said slotted sleeve.

4. The sleeve terminal of claim 1, wherein a substantially straight portion of each resilient arm is connected with the bent end thereof, a tab being connected with said straight portion, said tab being oriented radially with respect to said sleeve member; and wherein a V-shape portion is connected to said straight portion opposite said bent end.

5. The sleeve terminal of claim 4, wherein said sleeve member comprises a slotted sleeve; and wherein said plurality of resilient arms comprises a pair of mutually opposed resilient arms located on either side of a slot of said slotted sleeve.

6. A method of making an electrical connection between a pin terminal and a sleeve terminal, comprising the steps of:

fabricating a sleeve terminal comprising by a slotted sleeve member and a pair of resilient arms connected thereto, each resilient arm having at least a portion thereof characterized by a V-shape, wherein said step of fabricating further comprises fabricating each resilient arm with a free end;

placing a pin terminal receivably into the sleeve member so as to cause an expansion of said sleeve member; and placing the sleeve terminal into a barrel having an inside surface, wherein the resilient arms are compressed by the barrel so as to force the free end of each resilient arm to press against the sleeve member and thereby apply a normal force onto the sleeve member in a direction toward the pin terminal by transferring force back to the inside surface of the barrel, to thereby provide a ground path therebetween.

7. The method of claim 6, wherein said second step of placing provides a ground path between the sleeve terminal and the barrel.

8. The method of claim 6, wherein said step of fabricating further comprises fabricating each resilient arm with a radially directed tab; and wherein said second step of placing further comprises the tab and the free end of each resilient arm pressing against the sleeve member.

9. The method of claim 8, wherein said second step of placing provides a ground path between the sleeve terminal and the barrel.

* * * * *